United States Patent [19]

Haffer

[11] Patent Number: 4,640,078

[45] Date of Patent: Feb. 3, 1987

[54] COMPOSITE BAR

[75] Inventor: Dieter Haffer, Pirmasens-Gersbach, Fed. Rep. of Germany

[73] Assignee: Gebruder Kommerling Kunststoffwerke GmbH, Pirmasens, Fed. Rep. of Germany

[21] Appl. No.: 706,560

[22] Filed: Feb. 27, 1985

[30] Foreign Application Priority Data

Mar. 1, 1984 [DE] Fed. Rep. of Germany ..... 3407639

[51] Int. Cl.[4] ..... E06B 9/17

[52] U.S. Cl. ..... 52/731; 49/DIG. 1; 49/DIG. 2; 52/656; 52/788

[58] Field of Search ..... 428/34; 52/729, 730, 52/731, 732, 656, 788; 49/DIG. 1, DIG. 2

[56] References Cited

U.S. PATENT DOCUMENTS

| | | | |
|---|---|---|---|
| 2,750,637 | 6/1956 | Browne | 428/34 |
| 3,093,217 | 6/1963 | Doede | 49/DIG. 1 |
| 3,332,170 | 7/1967 | Bangs | 49/DIG. 1 |
| 4,113,905 | 9/1978 | Kessler | 428/34 |
| 4,271,238 | 6/1981 | Braithwaite et al. | 428/542 |

FOREIGN PATENT DOCUMENTS

| | | | |
|---|---|---|---|
| 2061901 | 6/1972 | Fed. Rep. of Germany . | |
| 1281664 | 10/1973 | Fed. Rep. of Germany . | |
| 2322254 | 4/1977 | France | 351/49 |

*Primary Examiner*—John E. Kittle
*Assistant Examiner*—Patrick J. Ryan
*Attorney, Agent, or Firm*—Armstrong, Nikaido, Marmelstein & Kubovcik

[57] ABSTRACT

The invention relates to a composite bar for example for window or door frames or shutters comprising a plastic hollow profile bar with an inner and outer surface.

Adjacent said surfaces substantially parallel thereto a metal flange is inserted into the interior of the plastic hollow profile bar. To increase the resistance to bending of this frame with respect to forces perpendicular to the window pane or door leaf without substantially reducing the thermal insulation the two metal flanges are connected together in shear-transmitting manner without metallic contact.

14 Claims, 16 Drawing Figures

COMPOSITE BAR

BACKGROUND OF THE INVENTION

1. Field of the Invention

The invention relates to a composite bar, in particular for window or door frames (both outer frames and sashes) and rolling shutters. Such a bar or rod can also be used for other purposes, for example for forming a folding shutter frame or walls made up of such bars for barracks, dismantlable houses and the like.

The plastic hollow profile bar is preferably made of thermoplastic plastic. It may comprise solid plastic as well as foamed plastic, in particular integral foam, preferably in each case of PVC.

2. Description of the Prior Art

A known window frame of composite bars surrounds a window pane, for instance of insulating glass or a door leaf which possibly may also have a particular heat-insulating effect.

Furthermore, rolling shutters are known comprising plastic bars in the cavities of which stiffening metal profiles are inserted which extend over the width of the cavities.

Now, door frames, window frames and sashes, rolling shutters and the like are required to have a good heat-insulating effect. It is also necessary for these frames and shutters to be particularly stiff with respect to forces applied perpendicularly to the plane of the window pane or door leaf or shutter.

A plastic window frame is already known (DE-PS No. 1,281,664) in which near the outer surface (weather side) and inner surface (indoor side) in each case a flat steel member parallel to the surface is inserted. Perpendicularly to the flat steel members, i.e. in the direction of any heat gradient occurring, two flat steel members are also inserted.

Whereas the flat steel members lying in each case parallel to the outer and inner surface hardly make an appreciable contribution to the aforementioned stiffness, the flat steel members disposed perpendicularly thereto extend in the direction of the heat transfer and thus form quite considerable heat bridges and consequently very much impair the insulating effect of the frame.

Instead of four flat steel members, it is also known to insert a closed rectangular metal profile having two flanges which lie respectively parallel to the inner and outer surfaces and two webs which connect the flanges together. Due to the connection of the flanges and webs, a closed hollow beam results which is exceedingly resistant to bending and thus imparts the desired stiffness to the profile section. However, in this case, as well, there is the disadvantage that the metal webs joining the two flanges form a heat bridge. The same disadvantage is present in the known rolling shutter bars with inserted metal stiffening bars.

SUMMARY OF THE INVENTION

It is therefore the object of the invention to provide a composite bar of a specified kind wherein the aforesaid disadvantages do not occur.

More particularly the invention is based on the problem of further developing a composite bar in such a manner that the advantages thereof are retained but that the heat-insulating effect is greatly improved.

Accordingly the invention provides a composite bar in particular for window frames or sashes, door frames and shutters, comprising a plastic hollow profile bar and an inner reinforcing bar which is inserted therein and which bears on two opposite sides of the plastic bar and comprises in the vicinity of each of the sides a flange, the two flanges being connected together in a shear transmitting manner, in which the flanges of the reinforcing bar are not metallically connected together and the flanges are connected together in shear-transmitting manner by at least one plastic bridge.

The two flanges, in a manner similar to aforementioned DE-PS No. 1,281,664, have no metal interconnection but nevertheless due to the plastic bridge(s) are in shear-transmitting connection. Consequently, the two flanges are not only loosely inserted metal strips contributing little to the stiffness and independent of each other, as in the subject of the aforementioned publication; on the contrary, with their shear-transmitting connection they form together a profile section, for example a T profile section or box section, which has a high edge spacing and thus a very high resistance to bending because the two flanges are disposed relatively close to the outside and inside surface of the composite bar respectively.

The two metal flanges should have a considerable spacing apart, at least a few millimetres, preferably several centimetres. The temperature gradient between the surfaces facing each other of the two metal flanges is as a rule high and consequently their spacing should also be as great as possible. The avoiding of metal webs according to the invention not only has the advantage of replacing the high thermal conductivity of metals by the substantially smaller thermal conductivity of plastics. In addition, it alone makes possible the utilization of the favorable radiation action of metals: Through gases, i.e. also through air, the heat exchange is mainly by radiation and this heat exchange is particularly small when the surfaces of different temperature consist of metals.

The shear-transmitting connection may be form-locking or material-locking and is preferably both. The respective form-locking or material-locking connection must be dimensioned so that it withstands the shear forces occurring under bending load in the longitudinal direction of the bars. Of particular advantage here is that the flanges at least with their surface directed to the outside or inside bear on the corresponding inner surfaces of the plastic hollow profile bar or fine guide ribs of the inner surfaces. The form locking is advantageously obtained by complementary profiling of the web edges adjoining the flanges and the flange portions adjoining the edges.

The flanges extend preferably in the major axis transversely of the heat gradients to be expected and consequently themselves contribute little to the heat transfer in particular when they are only very thin, as is readily possible with the frame according to the invention because each flange is not subjected to a load on its own but forms a bending-resistant profile together with the other flange.

This profile may for example be a box profile, a box profile with projecting flanges, a double T profile, a Z profile or possibly a C profile or a double L profile.

Fundamentally, it is also for example possible to insert two such profile sections adjacent each other into a common or respectively separate cavity of the plastic hollow profile bar.

For additional utilization of the force transmission from wall portions of the plastic hollow profile bar the reinforcing rod can also be adhered in the cavity thereof.

The plastic webs are preferably disposed at or near the side edges of the flanges; it is however also possible to use only a single central plastic web and finally another alternative is to adhere the flanges to each other by a hard foam insert instead of using a plastic web.

The flanges and the plastic webs of the reinforcing bar are preferably connected in that in the flange a series of edge notches are formed or holes disposed near the edge whilst the plastic webs have projections complementary to the edge notches or holes. It is thus possible to readily link the plastic webs and flanges together and thus form by form-locking force-transmitting engagement a flexurally stiff hollow profile bar.

The parts of this hollow profile bar can additionally be adhered together, for example to compensate tolerances, ensure easy handling and insertion and prevent any loosening in use.

For the metal flanges a metal sheet or strip material may be used which can be worked cheaply and simply. Preferably, the notches or holes are just as long as the intermediate spaces so that flanges can be punched without waste out of one metal sheet panel.

The webs in turn are conveniently of waste plastic, preferably PVC waste, which are extruded to form flat strips or particularly advantageously to form a panel which is then cut into the plastic webs.

Since these plastic webs are disposed invisibly in the interior of the frame no requirements are made of their appearance. It is thus possible to use waste of any type, also that with foreign material inclusions, as long as they do not obstruct the extrusion, for making the plastic webs. This permits not only the cheap production of plastic webs but also in a surprisingly simple manner the use and removal of plastic waste which accumulates in a works processing plastic and normally could be used again if at all after complicated cleaning, thus as a rule resulting in waste disposal problems.

According to several embodiments of the invention at least one of the longitudinal edges of the flanges may be angled towards the other flange so that a separately stiffened edge is formed which contributes to the stiffness of the flange.

It may be advantageous for the outer surface of such an angled edge to bear against adjacent walls of the plastic hollow profile bar to facilitate introduction of the reinforcing bar into the plastic hollow profile bar and further ensure a better force transfer into the reinforcing or stiffening bar.

It is further possible when one or both plastic webs are offset inwardly with respect to the edge of at least one of the flanges to bend said edge downwardly and again inwardly so that the webs can bear on the support edge thus formed. This measure also promotes the stiffness of the reinforcing bar and thus of the entire composite bar, in particular in the direction perpendicular to the main stress direction.

The invention covers not only the composite bar referred to but also window frames and sashes, door frames and rolling shutters made from said bars.

The subject of the invention will be explained for example in further detail with the aid of the attached schematic drawings, wherein:

FIG. 1 is a section through a window frame of profile section bars according to the prior art;

FIGS. 2, 5 or 8 to 13 are sections through various window frames or sashes of profile section bars according to the invention;

FIGS. 3 and 6 each show a view of an embodiment of a flange according to the invention;

FIGS. 4 and 7 each show a view of an embodiment of a plastic web according to the invention;

DESCRIPTION OF PREFERED EMBODIMENTS

Figure 1:
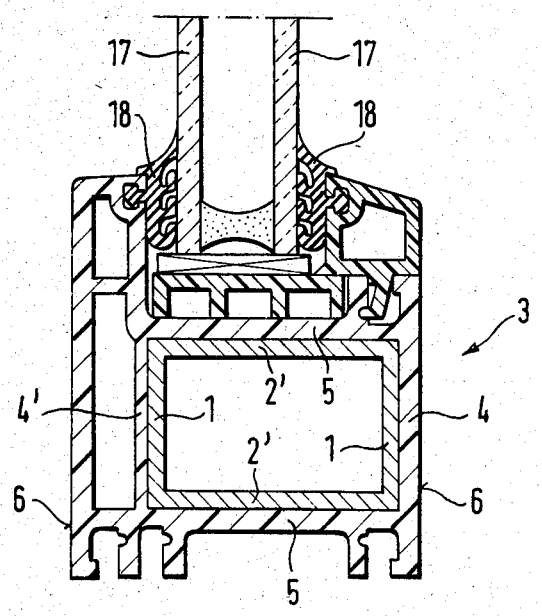
FIG.1 PRIOR ART

The various embodiments of the invention illustrated in the drawings are each preferred examples of embodiment but do not represent a restriction of the subject of the invention.

Insofar as plastic is used in these embodiments for loadbearing parts it is preferably thermoplastic, in particular PVC.

The metal of the flanges is preferably steel or sheet steel or an adequately hard aluminium alloy.

FIG. 1 shows the section through a known window sash comprising an insulating glass pane 17 embedded in seals 18 which are disposed in the frame illustrated.

The frame comprises as main element a composite bar comprising a plastic hollow profile bar 3 with two outer surfaces 6 each extending parallel to the glass pane 17 and directed away from the latter. One of the surfaces borders directly a wall 4 which with a stiffening wall 4' disposed near the other surface 6 and parallel thereto encloses a cavity of relatively large width in the direction considered perpendicularly to the glass pane 17.

The further makeup and composition of the frame is apparent from the drawings.

The aforementioned cavity left free between the two walls 4, 4' is defined on both sides by transverse walls 5 each extending perpendicularly thereto.

In this cavity having a closed rectangular profile extends a hollow profile section (consisting of steel or aluminium) having two flanges 1 which each extend parallel to the glass plane 17 and from the inside bear on the walls 4, and two webs 2' which extend transversely of the flanges 1 and join them together at their edges.

Due to the box profile bar 1, 2' which is enclosed in the plastic hollow profile bar 3 the latter has a high bending stiffness with respect to a load acting perpendicularly to the glass pane 17. Furthermore, the profile section shown is simple to make in that the steel or aluminium hollow profile 1, 2' is inserted into a plastic hollow profile bar, for example of integral foam or solid PVC.

A disadvantage in this case is the long double heat bridge which extends transversely of the frame (perpendicularly to the window pane 17) and which is formed by the metal webs 2' and establishes a good thermal connection between the two walls 4, 4', each of which is arranged near the adjacent frame surface.

The heat-insulating effect of the known frame is thus not optimal.

In the various subsequently described embodiments of door or window frame composite bars according to the invention in each case plastic hollow profile bars are explained which in the case of FIGS. 2, 5 and 8 to 13 correspond to the known frame shown in FIG. 1 and in the case of the remaining embodiments shown in the drawings differ only slightly from these known plastic hollow profile bars. The invention is not of course limited to the plastic hollow profile section shown.

Figure 12:
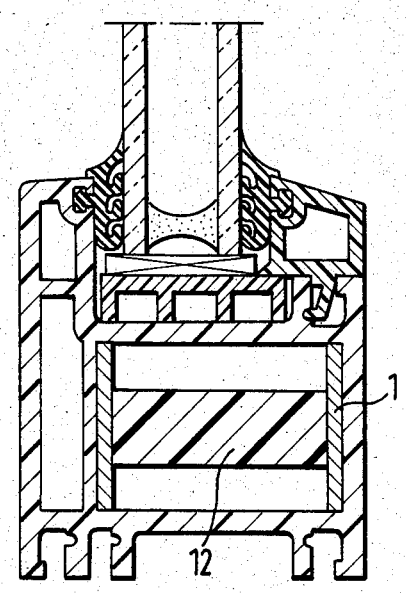
Figure 13:
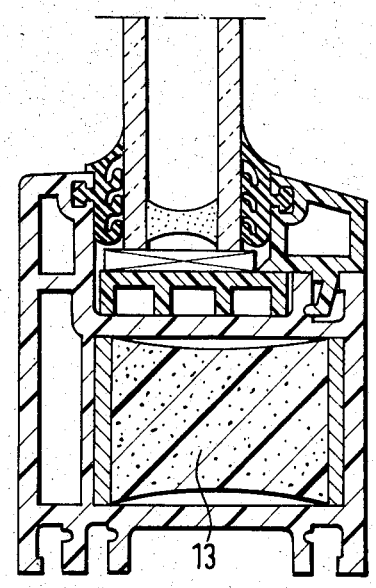
Figure 14:
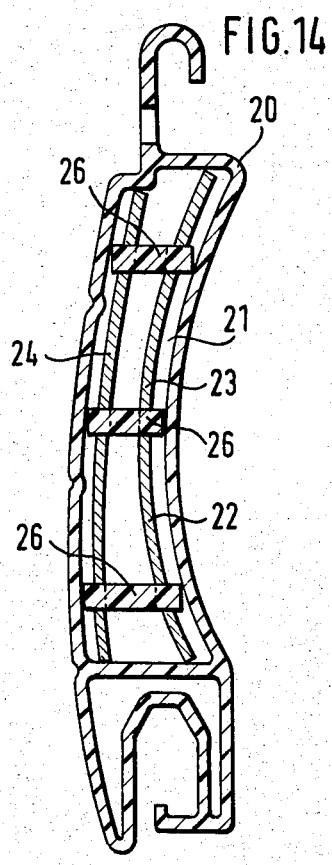
FIG. 14 is a section through a rolling shutter bar according to the invention.

In the embodiments of the invention which are shown in FIGS. 2, 5 and 8 to 13 in the plastic hollow profile bar section in each case a reinforcing bar is inserted which comprises on both sides a steel or aluminium flange 1 and which bears from the inside on the stiffening wall 4' and the outer wall 4 of the plastic hollow profile bar 3 or, as in FIG. 14, is spaced a small distance therefrom. This reinforcing or stiffening bar is inserted into the cavity of the plastic hollow profile bar 3.

Figure 2:
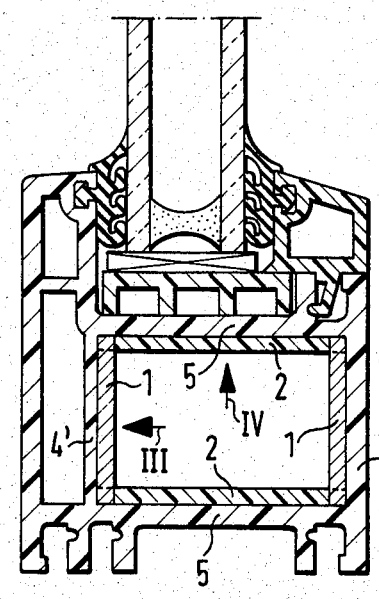

The reinforcing bar comprises in the embodiment of FIG. 2 in addition to the two flanges 1 punched out of flat metal sheet two plastic webs 2 which joined the two metal flanges 1 together in the region of their edges, the edges of the plastic webs 2 and the metal flanges 1 are interlinked and possibly also adhered together.

Figure 3:
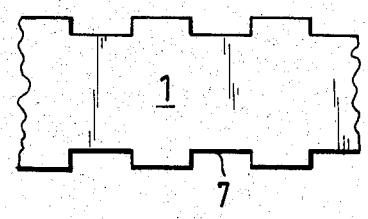

For this purpose each flange 1 comprises in the region of its edges elongated rectangular notches 7 (cf. FIG. 3 showing a view from the direction III of FIG. 2), the length of the notches 7 corresponding substantially to that of the projections between two successive notches 7.

The plastic web 2 is formed complementary to said notched flanges 1 and comprises itself projections 8 whose length corresponds to that of a notch 7 in FIG. 3, said projections engaging in the notches 7 and filling the latter.

Figure 4:
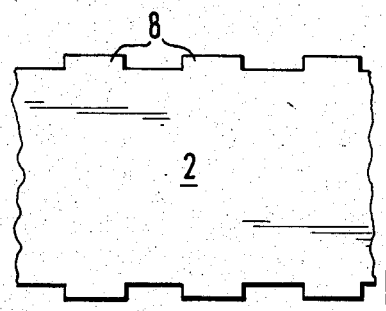

The plastic web is illustrated in FIG. 4 which shows a view of the web from the direction IV of FIG. 2.

In the construction of FIGS. 2 to 4 the two plastic webs 2 connect together in each case the outermost edges of the two flanges 1. Thus, the outer surface of each plastic web bears on the facing inner surface of the adjacent transverse wall 5.

Figure 5:
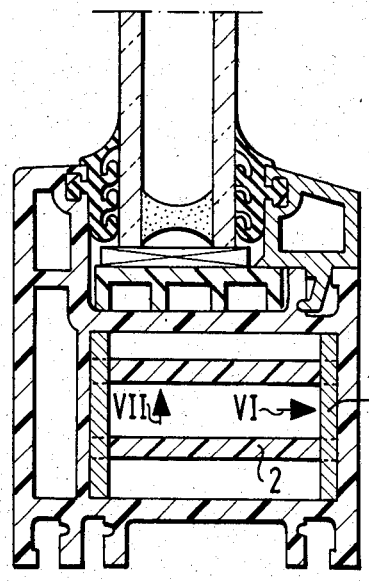
Figure 6:
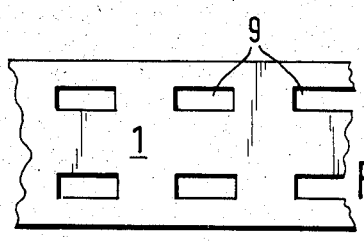
Figure 7:
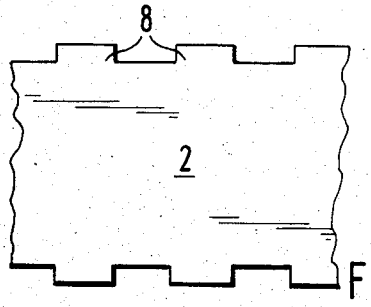

In FIGS. 5 to 7 the same illustration as in FIGS. 2 to 4 is shown of an example of embodiment in which the plastic webs are offset inwardly away from the respective free edge of the metal flanges 1. Otherwise (FIG. 7, showing the view VII of FIG. 5), the plastic webs 2 having the same form as the plastic webs 2 of the example of embodiment of FIG. 2. The flanges 1, which are illustrated in FIG. 6 (view VI in FIG. 5), do not have any notches at the edge but inwardly offset therefrom rectangular holes 9 in which the projections 8 engage, filling the holes 9.

The example of embodiment of FIGS. 5 to 7 is for example advantageous when the cavity receiving the reinforcing bar 1, 2 comprises lateral constrictions. The connection of the webs to the flanges can also then be made stronger.

Figure 8:
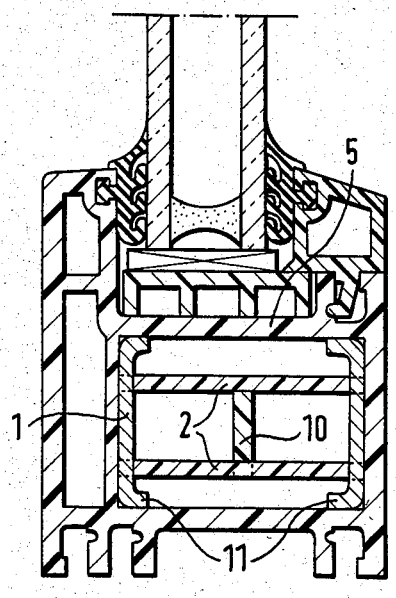

The embodiment shown in FIG. 8 comprises a combination of plastic webs 2 and metal flanges 1 corresponding to the embodiment illustrated in FIGS. 5 to 7. In contrast to the example of embodiment shown in the latter Figures, however, the outer edges of the flanges are bent towards the respective other flange so that the flange itself is better supported in the cavity of the plastic hollow profile bar 3 and is still stiffer, in particular with respect to stresses perpendicular to the main load direction.

Furthermore, the two webs 2 in the centre of the joining section between the two flanges 1 are stiffened by a centre flange 10 which can be made of metal or plastic and is interlinked with the two flanges 2. This embodiment is particularly suitable for relatively large distances between the two flanges 1, permits thinner wall thicknesses in the shear-transmitting plastic webs 2 and avoids any possible buckling.

The embodiment of FIG. 9 is similar to that of FIG. 5 but as in the subject of FIG. 8 each flange comprises an edge 11 bent towards the respective other flange and in the example of embodiment of FIG. 9 bent inwards again at the free end so that the end edge of the bent-over portion is supported against the respective adjacent plastic web. This embodiment permits on occurrence of high production tolerances also the pressing of the reinforcing bar into the associated cavity of the plastic hollow profile bar 3 which reduces the danger of buckling of the webs. In addition, the advantages outlined with regard to FIG. 8 are further intensified.

Figure 9:
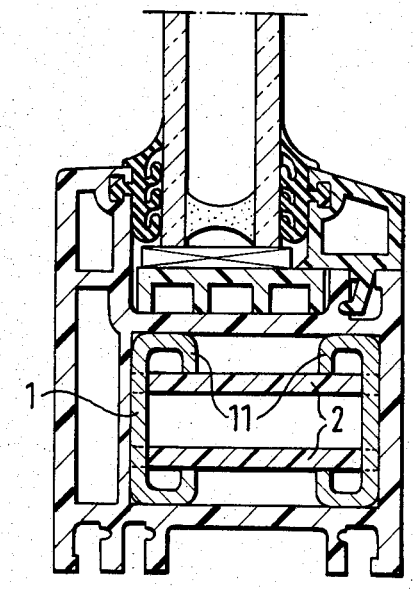
Figure 10:
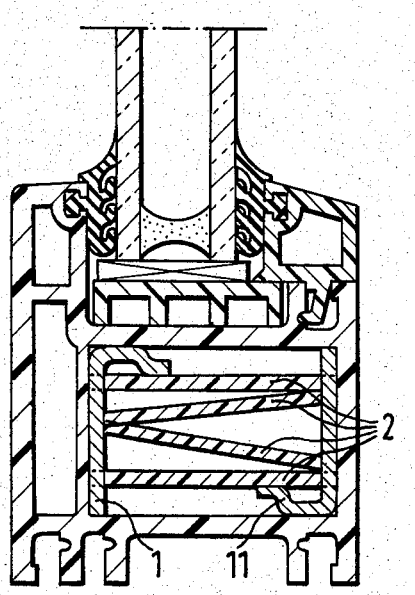

The subject of FIG. 10 is similar to that of FIG. 9 but each of the two flanges 1 is bent twice only at one of its sides and comprises the edge 11 bearing on the adjacent plastic web 2. Furthermore, spaced between the two plastic webs 2 are two further plastic webs which are in inclined arrangement so that the four plastic webs jointly have a M-shaped cross-section and consequently substantially mutually support each other against transverse forces. This arrangement also permits the introduction of the reinforcing bar into a relatively narrow cavity and thus permits high production tolerances because by the inclined position of two plastic webs the reinforcing bar is largely also insensitive to transverse forces. Such a construction is also advantageous when projections are provided at the inner walls or a non-rectangular cavity is to be reinforced.

Figure 11:
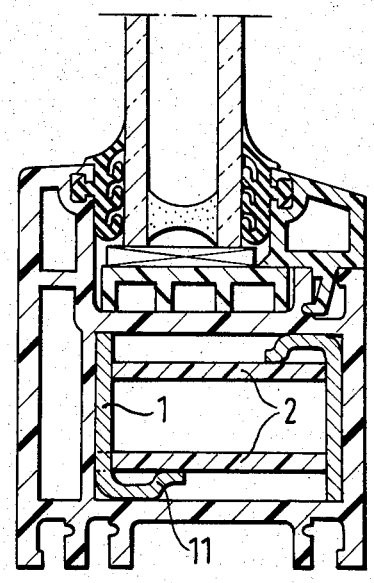

The embodiment of FIG. 11 corresponds to that of FIG. 10 but the two inclined reinforcing webs 2 are omitted.

Each of the metal flanges 1 comprises according to FIGS. 10 and 11 a bent edge only at one of its sides, the edge of the one flange being opposite the edgeless side of the other flange. This embodiment also permits forced insertion into a cavity so that in this example of embodiment as well the requirements made of the production accuracy are very low.

In the embodiment of FIGS. 12 and 13 only two planar metal strips are provided as flanges 1 which are connected by a centre web 12 which can also be a hard foam block 13 which by means of a bonding agent adheres in shear-resistant manner to the adjacent surfaces of the flanges 1.

Although in the examples discussed so far the cavity receiving the reinforcements is usually substantially rectangular it may also have a different profile, for example that of an H or of a right-angled Z. In this case the reinforcing bar preferably also has a H or Z profile, the web corresponding to the line joining the vertical sides of the H or the horizontal sides of the Z.

The use of individual profile section bars, i.e. not joined to form frames, is desired particularly in rolling shutters. These consist as a rule of numerous parallel bars or slats whose upper and lower edges are inserted into each other. On the one hand the bars should have the smallest possible thickness so that they can be wound up in a relatively small shutter box; on the other hand, the wind pressure and suction require adequate stiffness. Furthermore, rolling shutters serve for additional insulation at night, i.e. a temporary thermal insulation. The reinforcements according to the invention are very suitable for this purpose because they combine high stiffness with low thermal conductivity and in addition permit the radiation properties of metals providing small heat transfer through the air to be utilized.

Accordingly, cross-sections other than rectangular, in particular for shutter bars, are convenient and usually have a curved profile. FIG. 14 shows as further example of one of the preferred embodiments of the invention a rolling shutter bar or slat. The latter consists substantially of a hollow profile section 20 which is extruded from thermoplastic plastic, in particular impact-resistant PVC and which has the usual profile with no peculiarities which is illustrated in FIG. 14. The profile bar 20 comprises a cavity 21 into which a reinforcing bar 22 is inserted. The reinforcing bar 22 consists of two metal flanges 23 and 24 which are connected together by three webs 26. The reinforcing bar is dimensioned so that it can be easily inserted even in relatively long lengths into the plastic hollow profile bar 20. As apparent from the drawing the two flanges 23 and 24 extend slightly spaced from the adjacent walls of the bar 20, thus providing additional heat insulation. This spacing should however be small so that the spacing of the two flanges 23 and 24 from each other does not become too small.

Figure 15:
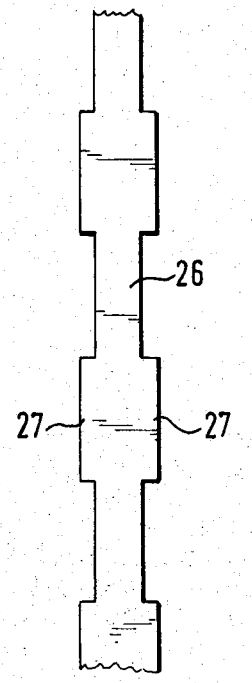
FIG. 15 is a view from above of a web of the reinforcing bar of the shutter bar.

Each flange 23 or 24 has in the example of embodiment three adjacently extending rows of holes 25. Engaging through these holes in each case with corresponding projections 27 are the webs 26 shown in plan view in FIG. 15 and consisting of thermoplastic plastic. The outermost edges of the projections 27 can bear on the inner walls of the cavity 21. As a result here as well the physical contact is slight and this further promotes the heat-insulating effect. Since the projections 27 of the webs 26 are guided in the corresponding holes 25 of the flanges 24 said webs can transmit shears satisfactorily so that a considerable stiffening of the finished shutter slat 20 provided with the reinforcing bar 22 is obtained.

FIG. 14 thus shows a shutter bar having a reinforcing bar in a cavity whose height is less in the center than at the edges. Preferably, the webs bear on the walls only with their narrow sides, the flanges not being in area contact. As a result, even when the tolerances add up unfavourably insertion is possible: Moreover, the additional cavities resulting increase the thermal insulation. To simplify the production by simple punching in this case the surfaces of the webs facing the cavity walls are perpendicular to the major surfaces thereof, i.e. usually not parallel to the cavity walls, although this of course would also be possible. Likewise, the slots of the flanges need not lie exactly in the direction of the webs; on the contrary, in this case as well a punching of the elongated holes perpendicularly to the flange surface is generally less complicated.

Such reinforcing profile sections can be made economically for example by simultaneously punching out the flanges and webs with subsequent insertion into each other and adhering of all parts.

If the shutter bar has not only one large cavity 21 but for example two cavities which are connected substantially at the level of the center web 26 by a corresponding transverse wall, into the two cavities correspondingly smaller reinforcing profile bars can be inserted whose metal flanges are connected together by plastic webs. It is of course also possible to insert a reinforcing bar according to the invention into only one of two or more cavities.

Figure 16:
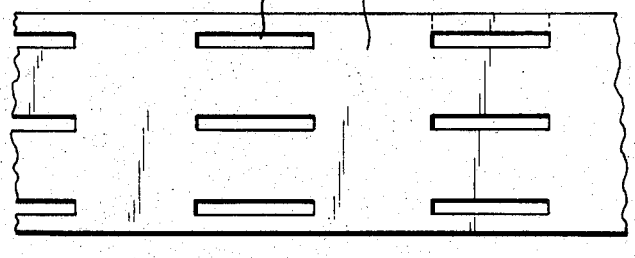
FIG. 16 is a view from the left of one of the two flanges of the reinforcing bar.

It is further pointed out that the assembly can be particularly facilitated when the flank of the openings extending adjacent the edge of the flange preferably stamped from sheet metal is omitted in each case so that the projections 27 of the webs 26 need no longer be inserted into holes but can be fitted in them from the side. To insure reliable retaining of the projections 7 in this case as well, as indicated in dotted line in the right upper hole 25 in FIG. 16 in each case at the ends of the hole a projecting nose is left behind which the corresponding projection 27 can engage. In corresponding manner on the plastic webs "noses" may be formed which after engagement define the spacing of the two metal flanges 23 and 24. This makes it possible to use metal sheet members with inaccurate curvature which yield resiliently when fitted together. If the curvature is not too pronounced it is even possible to process flat sheet metal without previous deformation.

What is claimed is:

1. In a composite bar, in particular for window frames or sashes, door frames and shutter, comprising a plastic hollow profile bar and an inner reinforcing bar which is inserted in the cavity of said hollow profile of said plastic bar after said plastic bar is formed, which bears on two opposite sides of said plastic hollow profile bar and which comprises in the vicinity of each of said sides a flange, the two flanges being connected together in a force-transmitting manner, the improvement that the two opposite flanges of the reinforcing bar consist of metal and are connected to each other non-metallically by at least one plastic bridge for transmitting forces, especially shear forces, between said two opposite metal flanges, said at least one plastic bridge engaging directly the opposite metal flanges.

2. Composite bar according to claim 1, in which the force-transmitting connection is a locking connection.

3. Composite bar according to claim 1, in which the flanges bear at least with their surfaces remote from each other on the corresponding inner surfaces of the plastic hollow profile bar.

4. Composite bar according to claim 1, in which the reinforcing bar consists of the two flanges and at least one plastic web.

5. Composite bar according to claim 4, in which the flanges are formed from sheet metal strips and comprise at least one row of holes and in which the plastic web comprise at its edges projections, the length of which correspond to that of the holes and which engage in said holes.

6. Composite bar according to claim 5 in which the flanges and the plastic webs are adhered together.

7. Composite bar according to claim 6, in which the intermediate spaces between the holes and projections are in each case substantially equal to the length thereof.

8. Composite bar according to claim 7 in which the outer surfaces of the plastic web bear on adjacent walls of the plastic hollow profile bar.

9. Composite bar according in claim 7 in which the outer surfaces of the plastic web are spaced from the walls adjacent thereto of the plastic hollow profile bar.

10. Composite bar according to claim 9, in which at least one end edge of at least one of the flanges comprises an edge bent towards the other and preferably bearing at least partially on the adjacent wall of the plastic hollow profile bar.

11. Composite bar according to claim 10, in which the plastic webs are connected together by a center flange of plastic or metal extending substantially parallel to the flanges.

12. Composite bar according to claim 11, in which the plastic webs consist of extruded waste of plastic, preferably PVC.

13. Composite bar according to claim 10, in which the end edge of at least one of the edges is bent inwardly and bears against the adjacent plastic web.

14. Composite bar according to claim 1, in which the plastic bridge is formed by a plastic foam block joining the two flanges in a shear or force-transmitting manner.

* * * * *